United States Patent [19]

Yamamoto et al.

[11] 4,314,014

[45] Feb. 2, 1982

[54] ELECTROPHOTOGRAPHIC PLATE AND PROCESS FOR PREPARATION THEREOF

[75] Inventors: Hideaki Yamamoto, Hachioji; Akio Taniguchi, Hino; Shinkichi Horigome, Tachikawa; Susumu Saito, Hachioji; Yoshiaki Mori, Tokyo; Eiichi Maruyama, Kadaira, all of Japan

[73] Assignee: Hitachi, Ltd., Tokyo, Japan

[21] Appl. No.: 158,369

[22] Filed: Jun. 11, 1980

[30] Foreign Application Priority Data

Jun. 15, 1979 [JP] Japan ..... 54-74661
Oct. 19, 1979 [JP] Japan ..... 54-134163

[51] Int. Cl.[3] ..... G03G 5/08; G03G 5/082

[52] U.S. Cl. ..... 430/57; 430/85; 430/64; 430/79; 430/95

[58] Field of Search ..... 430/57, 85, 84, 64, 430/66, 67, 95, 79

[56] References Cited

U.S. PATENT DOCUMENTS 2,962,376 11/1960 Schaffert ..... 430/57
3,655,377 4/1972 Sechak ..... 430/57
4,088,485 5/1978 Ing et al. ..... 430/85

*Primary Examiner*—Richard L. Schilling
*Assistant Examiner*—John L. Goodrow
*Attorney, Agent, or Firm*—Craig and Antonelli

[57] ABSTRACT

Disclosed is an electrophotographic plate having a laminated structure comprising a first Se layer containing 3 to 10% by weight of As, a second Se layer containing 40 to 47% by weight of Te and 3 to 10% by weight of As and a fourth Se layer consisting solely of Se or comprising Se and up to 10% by weight of As or an organic semiconductor layer, wherein a substrate is arranged so that at least the face of the substrate which is contiguous to the face of one of said first Se layer and said fourth Se layer or organic semiconductor layer, that is located on the outer side of the laminated structure, is electrically conductive.

It is preferred that the fourth Se layer be formed by vacuum evaporation deposition while maintaining the substrate temperature at 50° to 80° C. The residual potential of the electrophotographic plate can be reduced.

20 Claims, 17 Drawing Figures

ELECTROPHOTOGRAPHIC PLATE AND PROCESS FOR PREPARATION THEREOF

BACKGROUND OF THE INVENTION (1) Field of the Invention

The present invention relates to an electrophotographic plate for use in an electrophotographic device or a laser beam printer equipment using He-Ne laser or semiconductor laser, which has a sufficient sensitivity when the wavelength of an illuminating light source is 600 to 800 nm.

(2) Description of the Prior Art

Se electrophotographic plates having a thickness of about 50 μm have heretofore been mainly used in an electrophotographic device or a laser beam printer equipment using He-Cd laser (emission wavelength=442 nm). Such Se electrophotosensitive plate has a sensitivity to short wavelength beams of 400 to 500 nm but has no substantial sensitivity to beams having a wavelength longer than 700 nm. Semiconductor laser devices have recently been put into practical use, and development of so-called semiconductor laser beam printer equipments where writing is accomplished by semiconductor laser has been desired. Since the emission wavelength of semiconductor laser is about 800 nm, conventional Se electrophotographic plates cannot be used for this purpose.

Conventional electrophotographic plates are disclosed in, for example, the following references.

1. U.S Pat. No. 2,753,278 to W. E. Bixby
2. U.S. Pat. No. 3,077,386 to R. M. Blankney
3. U.S. Pat. No. 2,803,542 to O. A. Ullrich
4. C. J. Young, et al., RCA Rev., 15, 469 (1954)
5. E. C. Giaimo, RCA Rev., 23, 96 (1962)

SUMMARY OF THE INVENTION

It is a primary object of the present invention to provide an electrophotographic plate having a sensitivity to beams having a wavelength of about 600 to about 800 nm.

In accordance with the present invention, there is provided an electrophotographic plate having a laminated structure comprising a first Se layer containing 3 to 10% by weight of As, a second Se layer containing 40 to 47% by weight of Te and 3 to 10% by weight of As and a fourth Se layer consisting solely of Se or comprising Se and up to 10% by weight of As or an organic semiconductor layer, wherein a substrate is arranged so that at least the face of the substrate which is contiguous to the face of one of said first Se layer or said fourth Se layer or organic semiconductor layer, that is located on the outer side of the laminated structure, is electrically conductive.

It is preferred that the fourth Se layer be formed by vacuum evaporation deposition while maintaining the substrate temperature at 50° to 80° C. The residual potential of the electrophotographic plate can be reduced.

DETAILED DESCRIPTION OF THE PREFERRED EMBODIMENTS

Figure 1:
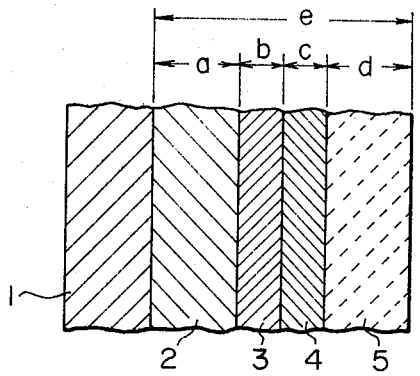
FIG. 1 is a sectional view illustrating the structure of the electrophotographic plate according to the present invention.

The electrophotographic plate has a structure in which an Se layer having Te incorporated (added) at a high content and an Se layer having As at a high content are sandwiched between an Se layer containing 3 to 10% by weight of As and an Se layer containing 0 to 10% by weight of As. A typical instance of this structure of the electrophotographic plate is shown in FIG. 1. The electrophotographic plate will now be described with reference to FIG. 1.

Figure 2A:
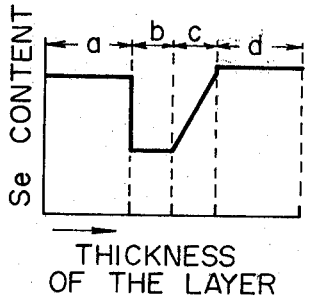
FIGS. 2*a* to 2*c* are diagrams illustrating the concentration distributions of Se, As and Te in the electrophotographic plate according to the present invention.
Figure 2B:
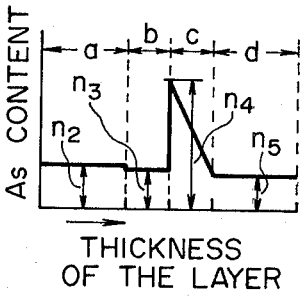
Figure 2C:
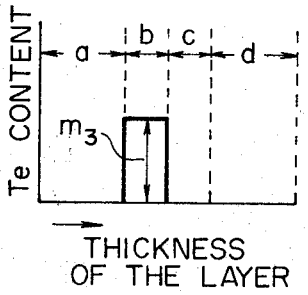

FIG. 1 is a sectional view showing the structure of the electrophotographic plate and FIGS. 2*a*, 2*b* and 2*c* show the Se, As and Te concentration distributions, respectively, in the electrophotographic plate shown in FIG. 1. In case of an electrophotographic device, an aluminum plate or drum is ordinarily used as the conductor 1. However, a glass sheet on which an n-type transparent conductive layer (for example, a conductive layer composed of at least one member selected from oxides of tin, indium, titanium, tantalum, Zinc and (thallium) is formed, or a glass sheet on which a layer of a metal such as aluminum, chromium or gold is formed, may be used as the conductor 1.

When the conductor 1 is opaque, beams are incident on the electrophotographic plate from the side opposite to the conductor 1 (the right side). If the conductor 1 is transparent, beams may be incident on the electrophotographic plate from either the left side or the right side. An Se layer 2 (hereinafter called "first Se layer") having an As concentration n2 and a thickness a is formed on the conductor 1. An Se layer 3 (hereinafter called "second Se layer") having an As concentration n3, a Te concentration m3 and a thickness b is formed on the first Se layer 2, and an Se layer 4 (hereinafter called "third Se layer") having a thickness c and containing As in such a manner that the As concentration is gradually decreased in the thickness direction from n4 to about n5 is formed on the second Se layer 3. Finally, an Se layer 5 (hereinafter called "fourth Se layer") having an As concentration n5 and a thickness d is formed on the third Se layer 4. Functions of the respective layers will now be described.

The Se layer 3 (second Se layer) is first described. The bandgap of Se is about 2 eV and Se has no substantial sensitivity to beams having a wavelength longer than 550 nm. This holds good also with respect to Se containing up to 10% by weight of As. When Te is incorporated (added) in such Se, for example, at a concentration of 50% by weight, the bandgap is reduced to 1.58 eV and Te-incorporated Se comes to have a sensitivity to beams having a wavelength of about 800 nm. As is seen from this illustration, the Se layer 3 is formed to increase the sensitivity to beams having a wavelength of 550 to 800 nm. The content m3 of Te incorporated in this layer is within a narrow range of from 40 to 47% by weight. As the content of Te is increased, the sensitivity is gradually increased, and the sensitivity is at its peak when the Te content is 47% by weight. If the Te content exceeds 50% by weight, the sensitivity is abruptly reduced. Since the bandgap is substantially linearly reduced with increase of the Te content, the quantity of the carrier generated by thermal excitation is increased with increase of the Te content, resulting in increase of the dark current (dark decay). When the Te content m3 exceeds 47% by weight, the dark current is abruptly increased and the intended object cannot be attained. Accordingly, the Te concentration of content m3 is determined so that a good balance is attained between the sensitivity and the dark current. No practical problem arises when the Te content m3 is in the range of from 40 to 47% by weight. The thickness b of the Se layer 3 is now described. If the thickness is smaller than 60 nm, the absorption quantity of beams is small and no substantial sensitization is attained. If the thickness is increased beyond 60 nm, the sensitivity is increased with increase of the thickness and the sensitivity becomes saturated when the thickness is increased to about 180 nm or more. When the thickness exceeds 300 nm, the sensitivity is reduced. If the thickness b of this Se layer 3 is too large, the dark current is increased or the sensitivity is readily degraded when the operation is conducted for a long time. Therefore, it is most preferred that the thickness b of the Se layer 3 be in the range of from 60 to 200 nm. As is incorporated at the concentration n3 in the Se layer 3. The function of this As is now described. Se or Se containing Te is ordinarily in the amorphous state, and the material of this type is poor in the heat stability and is readily crystallized even at room temperature to cause phase transition to metallic Se or Se-Te alloy. This tendency is especially conspicuous in Te-containing Se. As is added to prevent occurrence of this phase transition to the crystal, and from the practical viewpoint, it is most preferred that As be added at a concentration of 3 to 10% by weight. If the As content n3 exceeds this range, no good results are obtained because the sensitivity is degraded when the operation is conducted for a long time.

The Se layer 4 (third Se layer) will now be described. This electrophotographic plate is used in the state where a voltage is applied so that the conductor 1 has a positive polarity (the surface of the Se layer 5 is negatively charged). Accordingly, an electron or hole generated in the above-mentioned Se layer 3 is caused to run to the left or right. In this case, if there is not present the Se layer 4, since the bandgap of the Se layer 3 is 1.6 eV and the bandgap of the Se layer 5 is about 2.0 eV, an energy barrier is formed between the Se layer 3 and the Se layer 5, whereby injection of the hole generated in the Se layer 3 into the interior of the Se layer 5 inhibited. The Se layer 4 is formed to eliminate this energy barrier between the Se layer 3 and the Se layer 5. If As is incorporated into Se, the bandgap is reduced substantially linearly with increase of the As concentration, and in case of Se containing 40% by weight of As, the bandgap is about 1.7 eV. In the Se layer 4, the As concentration is gradually reduced from the highest content n4 to the level n5. Accordingly, in the case where the Te concentration in the Se layer 3 is 40 to 47% by weight, if this maximum concentration n4 is adjusted to 30 to 40% by weight, the band of the Se layer 3 is rendered smoothly contiguous to the band of the Se layer 5 by virtue of the presence of the Se layer, and therefore, the hole generated in the Se layer 3 can be injected into the Se layer 5 without transit of the hole being inhibited and the electrophotographic plate is hence rendered sensitive. If the thickness c of the Se layer 4 is smaller than 60 nm, the above-mentioned effect is reduced. Accordingly, it is necessary that the thickness c of the Se layer 4 should be at least 60 nm. In addition to the above-mentioned effect of rendering the bands of the layers 3 and 5 contiguous to each other, the Se layer 4 exerts another important effect. If As is incorporated into Se, a localized state is brought about in the interior of the bandgap and the electron is readily trapped. Accordingly, the layer containing As incorporated at a high content comes to have a negative space charge. This negative space charge intensifies the electric field applied to the Se layer 3 and the hole generated in the interior of the Se layer 3 is readily attracted into the interior of the Se layer. However, if the region c of this negative space charge is too long, the hole running to the Se layer 5 from the Se layer 3 is extinguished in the region c by recombination. Accordingly, the region c should not be too long. Namely, it is preferred that the thickness c of the Se layer 4 be smaller than 200 nm. In the embodiment shown in FIG. 1, in the Se layer 4, the As concentration is gradually decreased in the thickness direction. This structure, however, is difficult to produce, and a structure for the Se layer 4 in which the As concentration is uniformly maintained at 30 to 40% by weight can be produced more easily (also in this case, since the effect of drawing out the hole by negatively charging the Se layer 4 can be attained, the desired sensitivity can be obtained). In this case, however, the operation voltage becomes higher by about 20% than the operation voltage required when the As content is gradually reduced in the thickness direction.

The functions of the Se layer 2 (first Se layer) and the Se layer 5 (fourth Se layer 4) will now be described. As described hereinbefore, the electron and hole generated in the Se layer 3 move toward the Se layer 2 and the Se layer 5, respectively, and the electron Se is injected in the interior of the Se layer 2 and is allowed to transit this Se layer and arrive at the conductor 1. On the other hand, the hole is guided into the interior of the Se layer 5 by the Se layer 4 and is extinguished by recombination with the negative charge on the negatively charged surface of the Se layer 5. Thus, the Se layer 2 and Se layer 5 act as transport layers for the electron and hole, respectively. In addition, these layers 2 and 5 exert various other functions. The Se layer 2 contains As at the content n2. This As is incorporated to prevent Se from being crystallized to metallic Se, that is, to prevent the phase transition of Se. When crystallization of Se takes place, crystal nuclei are more readily formed in the interface between the Se layer 2 and the conductor 1 than in the interior of the layer 2. Accordingly, it is preferred that the As content n2 be at least 3% by weight. However, as pointed out hereinbefore, if the As content n2 exceeds 10% by weight, formation of the localized state in the bandgap becomes conspicuous and the negative space charge is increased, with the result that the hole is drawn from the conductor 1 into the Se layer 2 and the dark current is extremely increased. Furthermore, because of this negative space charge, the electric field distribution in the interior of the electrophotographic plate is changed to render the sensitivity unstable. Therefore, the As content n2 in the Se layer should not exceed 10% by weight. The thickness a of the Se layer should be at least 20 nm. If the thickness a is smaller than 20 nm, the Se layer 3 becomes too close to the conductor 1. In this case, since the bandgap of the Se layer 3 is small, the hole is injected into the Se layer 3 from the conductor 1 and the dark current (dark decay) is extremely increased, with the result that the electrophotographic plate cannot be put into practical use. On the other hand, if the thickness a is too large, the following problem arises. In Se, the mobility of the electron is 1/100 or less of the mobility of the hole, and this holds good also in respect to Se containing several % by weight of As. This means that transit of the electron through the Se layer 2 is difficult. Furthermore, as pointed out hereinbefore, As has a property of easily trapping the electron. Therefore, if the thickness a of the Se layer 2 is too large, a negative space charge is generated and the sensitivity is rendered unstable. Accordingly, it is preferred that the thickness a be smaller than 1 μm. Especially when beams having a wavelength shorter than 650 nm are incident from the side of the conductor 1, since the beams are absorbed in the Se layer 2, the sensitivity is increased if the thickness a is reduced as much as possible. Since the Se layer 2 hardly absorbs beams having a wavelength longer than 700 nm, if such beams are used, the sensitivity is not changed even when the thickness a is increased to some extent. When beams are incident from the side of the surface of the Se layer 5, the beams should be limited to those having a wavelength longer than 700 nm. If incident beams have a wavelength shorter than 700 nm, substantially all of these beams are absorbed in the Se layer 5 and no substantial sensitivity is obtained. As is incorporated in the Se layer 5 for preventing crystallization of Se. If prolongation of the life of the electrophotographic plate is of no practical significance, the As concentration n5 may be 0%. In order to prevent crystallization, the As content n5 may be up to 10% by weight, preferably up to 3% by weight. The thickness d of the Se layer 5 is ordinarily at least about 1 μm. When the electrophotographic plate is used for an electrophotographic device or laser beam printer equipment, the thickness d of the Se layer is adjusted to about 50 μm in view of the withstand voltage. Accordingly, the thickness of the Se layer 5 is much smaller than those of the other Se layers. If several % by weight of As is incorporated in the Se layer 5, the hole-trapping property is enhanced and the residual potential is increased, causing undesirable adverse effects. When the As content n5 is 10% by weight, the residual potential of the electrophotographic plate is at least 3 times as high as the residual potential observed when the As content n5 is 0% by weight. Therefore, it is preferred that the As content n5 be lower, that is, less than 10% by weight. This electrophotographic plate operates very conveniently at an average electric field of at least $1.25\times10^5$ V/cm. Accordingly, if the total thickness e is 4 μm, the electrophotographic plate operates at 50 V, and if the total thickness e is 20 μm or 50 μm, the electrophotographic plate operates at 250 V or 600 V. The total thickness e is changed by adjusting the thickness d.

In the above-mentioned electrophotographic plate, the Se layer 5 acts in principle as the transport layer for the carrier. Accordingly, Se should not inevitably be used for the layer 5.

An organic semiconductor layer may be used instead of this Se layer 5. This organic semiconductor layer should have the following properties.

First, the organic semiconductor layer should have a so-called photoconductive property. That is, transfer of charges should be easily performed in the organic semiconductor layer. In the second place, the organic semiconductor layer should preferably have an electric resistance of from about $10^{+8}$ to about $10^{+15}$ Ω-cm. If the resistance is higher than $10^{+15}$ Ω-cm, it becomes difficult to apply an average electric field of at least $1.25\times10^5$ V/cm to the Se layer 3, and generated optical carriers cannot be effectively separated and the sensitivity is reduced. If the resistance is lower than $10^{+8}$ Ω-cm, the surface charge retaining capacity is reduced and an image of good quality can hardly be obtained. In order to inject holes into the organic semiconductor layer 5 from the Se layer 3 at a high efficiency, it is preferred that the ionizing potential of the organic semiconductor be small.

As the organic semiconductor, there are effectively used poly(vinyl carbazole), a mixture of poly(vinyl carbazole) with an electron acceptor such as iodine, a stilbene dye, a non-ionic cyanine dye and a pyrazoline derivative. Typical instances are as follows.

(1) Poly(vinyl carbazole) derivatives having the following structural units:

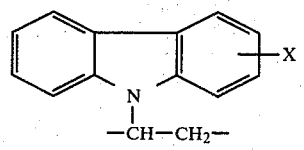

wherein X is a hydrogen atom or a substituent.

More specifically, homopolymers of N-vinylcarbazole and copolymers of N-vinylcarbazole with other vinyl monomer are included. Of course, polymers in which hydrogen atoms on the carbazole ring in the polymer molecule chain are substituted by a halogen atom, a nitro group, an alkyl group, an aryl group, an alkylaryl group, an amino group or an alkylamino group are included. Ordinarily, hydrogen atoms at the 3-and 6-positions of the carbazole ring are readily substituted.

(2) Pyrazoline and derivatives thereof.

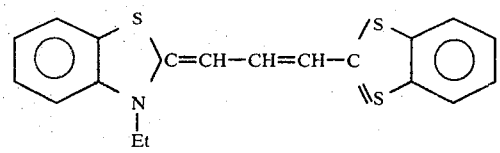

(3)

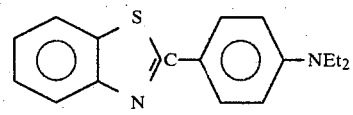

(4)

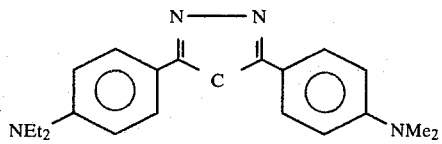

(5)

In the above formulae, Et stands for an ethyl group, and Me stands for a methyl group.

Among these organic semiconductors, carbazole type vinyl polymers and pyrazoline and its derivatives are practically valuable.

It is preferred that the thickness of the organic semiconductor layer be in the range of from 1 μm to 20 μm.

The material of the Se layer 4 may be an organic semiconductor. If a material having a bandgap value intermediate between those of the Se layer 3 and the organic semiconductor layer 5 is arranged as the layer 4, the energy barrier between the layers 3 and 5 can be reduced. Accordingly, an organic semiconductor having such bandgap value may be used for the layer 4.

If the difference of the bandgap value between the Se layer 3 and the organic semiconductor layer 5 is small, the Se layer 4 need not be formed.

When the organic semiconductor layer is used, the majority of the thickness of the photosensitive region is occupied by the organic semiconductor layer. Furthermore, since the organic semiconductor layer can be prepared by a method other than vacuum evaporation deposition method, the manufacturing cost can be reduced. Moreover, by the use of the organic semiconductor, there can be attained an advantage that the electrophotographic plate may be formed into not only a drum-like shape but also a belt-like shape.

Various advantages described hereinafter can be attained if an insulating layer of an n-type oxide having a thickness of about 5 to about 50 nm is interposed as the carrier blocking layer between the conductor and the Se layer 2. As typical instances of the n-type oxide, there can be mentioned $CeO_3$, $Al_2O_3$, $Nb_2O_5$, GeO, CrO, $CrO_2$, $Cr_2O_3$, $WO_2$, $WO_3$, $Ta_2O_5$, $Ta_2O_4$, $Y_2O_3$, SiO, $MgF_2$ and $Sb_2O_3$. Similar advantages can be attained by formation of an n-type conductive layer composed of at least one member selected from the group consisting of sulfides, selenides and tellurides of Zn and Cd.

In the first place, injection of holes into the Se layer 2 from the substrate 1 is prevented, resulting in reduction of the dark current. In the second place, diffusion of impurities contained in the substrate 1 into the Se layer 2 is prevented. Especially when an alkali metal is contained as the impurity in the substrate 1, if this impurity is diffused in the Se layer 2, crystallization of Se is readily caused. Accordingly, if the above-mentioned insulating layer is disposed, the life of the electrophotographic plate can be remarkably prolonged.

The relation between the temperature adopted for formation of the above-mentioned electrophotographic plate and the residual potential will now be described. The residual potential is determined by the Se layer 5 occupying the major portion of the electrophotographic plate. If the temperature adopted for formation of this layer is adjusted to 50° to 80° C., the residual potential is reduced below $\frac{1}{3}$ of the residual potential observed when room temperature is adopted, and characteristics of the electrophotographic plate can be improved and the sensitivity can be maintained at the same level. The atmosphere is kept in the vacuum stage. When the formation temperature is lower than 50° C., the residual potential is not substantially different from the residual potential obtained at room temperature. If the formation temperature exceeds 80° C., the once formed layer is evaporated again and holes are formed on the surface of the resulting electrophotographic plate, or Te in the Se layer 3 is diffused in the Se layer 2 or the Se layer 4. Accordingly, the sensitivity is reduced and no good results are obtained. Of course, the entire structure of the electrophotographic layer may be formed at a temperature of 50° to 80° C. The relation between the substrate temperature at the formation of the fourth Se layer 5 and the residual potential is shown in Table 1.

TABLE 1

| Substrate Temperature (°C.) | Residual Potential (%) |
|---|---|
| 25 | 52 |
| 40 | 10 |
| 50 | 3 |
| 60 | 2 |
| 70 | 2 |
| 80 | 2 |
| 90 | holes formed by re-evaporation |
| 100 | " |

From the data shown in Table 1, it will readily be understood that especially good results can be obtained when the substrate temperature is in the range of from 50° to 80° C.

When the electrophotographic plate having the aboveillustrated structure shown in FIG. 1 is utilized for an electrophotographic device or laser beam printer equipment, since the Se layer 3 acting as the center of photoelectric conversion is located in an inner portion of the plate, there can be attained an advantage that even if the electrophotographic plate is damaged by frictional contact with a recording paper at the transfer step, the sensitivity is not degraded and a clear image of good quality can be obtained.

Figure 3:
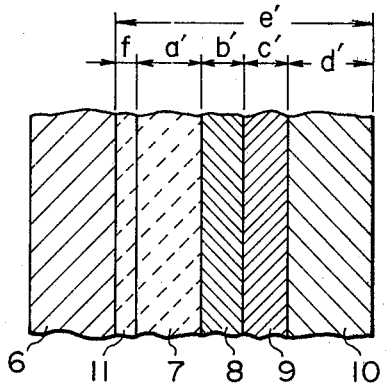
FIGS. 3 and 6 are sectional views showing another instances of the structure of electrophotographic plate according to the present invention.
Figure 4A:
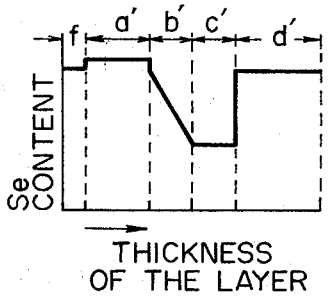
FIGS. 4*a* to 4*c* are diagrams illustrating the concentration distributions of Se, As and Te in the electrophotographic plate according to the present invention.
Figure 4B:
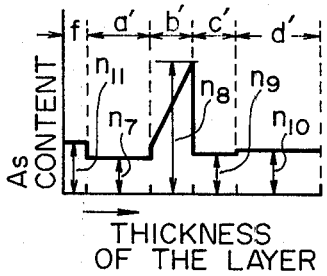
Figure 4C:
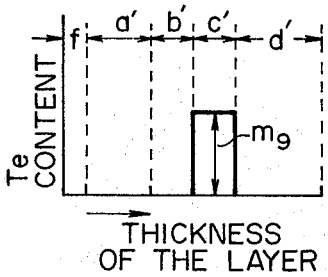

Another embodiment of the structure of the electrophotographic plate according to the present invention is shown in FIG. 3. The electrophotographic plate shown in FIG. 3 has a structure formed by reversing the structure shown in FIG. 1 in the left-right direction, though an Se layer 11 containing As at a content n11 of 3 to 10% by weight is additionally formed on a conductor 6. FIG. 3 is a sectional view showing the structure of the electrophotographic plate, and FIGS. *4a*, *4b* and *4c* are diagrams illustrating the concentration distributions of Se, As and Te, respectively. Referring to FIG. 3, an Se layer 7 is formed of Se containing As at a concentration n7 of 0 to 10% by weight, and in an Se layer 8, the As concentration is increased in the thickness direction from n7 to n8 which is in the range of 30 to 40% by weight. The thickness b' is preferably in the range of from 60 to 200 nm. An Se layer 9 is formed of Se containing Te at a content m9 of 40 to 47% by weight and As at a content n9 of 3 to 10% by weight, and the thickness c' is preferably in the range of from 60 to 200 nm. The Se layer 11 is formed to prevent occurrence of crystallization of Se in the interface between the conductor 6 and the Se layer, and it is sufficient if the thickness f is in the range of from 20 to 100 nm. Especially when the As content in the fourth Se layer is lower than 2% by weight or this layer is formed solely of Se, by insertion of this crystallization-preventing layer, the life of the electrophotographic plate can be prolonged. Ordinarily, Se containing up to 10% by weight of As is ordinarily used for this Se layer 11. In case of the electrophotographic plate of this embodiment, a voltage is applied so that the conductor comes to have a negative polarity (the surface of the Se layer is positively charged). Accordingly, the operation of the electrophotographic plate is the same as that of the electrophotographic plate shown in FIG. 1. Therefore, explanation of the operation is omitted.

The electrophotographic plate having the structure shown in FIG. 3 is characterized in that when beams are incident from the side opposite to the conductor 6 (from the right side), a high sensitivity is attained to beams in a broad wavelength range of from 400 to 800 nm. However, if this electrophotographic plate is used for an electrophotographic device or laser beam printer equipment, the electrophotographic plate is readily damaged at the transfer step. Accordingly, it is necessary that the Se layer 9 acting as the main part of photoelectric conversion region should be prevented from being damaged. For this purpose, it is preferred that the thickness d' of the Se layer 10 be as large as possible.

Figure 10:
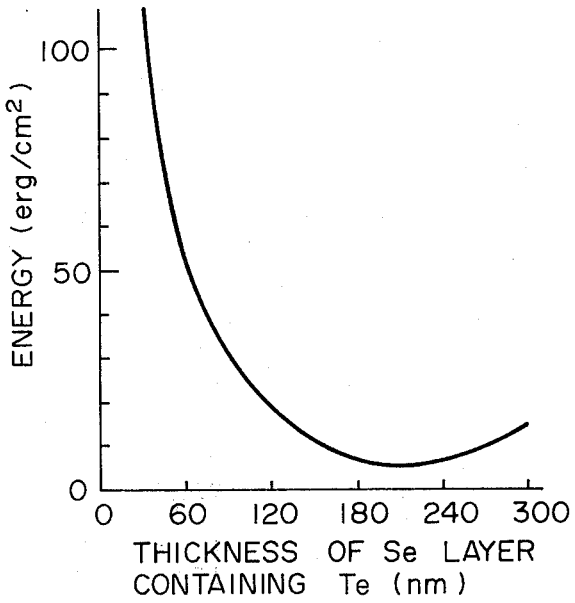
FIG. 10 is a diagram illustrating the relation between the thickness of the Te-containing Se layer and the sensitivity.

If an insulating layer of $CeO_2$ or $Al_2O_3$ having a thickness of about 30 nm is formed on the surface of the Se layer 10 shown in FIG. 10, the following advantages can be attained. In the first place, if such insulating layer is formed, positive charges applied thereto are prevented from being directly injected into the Se layer 10 and the dark current is reduced. Another advantage is that since such insulating layer is very tough, the mechanical strength of the surface of the electrophotographic plate is improved. If this electrophotographic plate is used for an electrophotographic device or laser beam printer equipment, in order to protect the electrophotographic plate from being damaged, a protective layer having a resistance to printing may be formed. A typical instance of the material for this protective layer is an organic transparent conductor such as poly(vinyl carbazole).

When the electrophotographic plate shown in FIG. 1 or 3 is used for an electrophotographic device or laser beam printer equipment, the surface of the electrophotographic plate is positively or negatively charged by corona discharge to thereby apply a voltage to the electrophotographic plate and operate the electrophotographic plate. Of course, even when an electrode of a metal such as Au or Al, a semitransparent metal electrode or an indium oxide transparent electrode is formed on the surface of the electrophotographic plate, the electrophotographic plate can be operated by applying a voltage between such transparent electrode and the conductor substrate. Charging means is not limited to corona discharge, and the electrophotographic plate can be similarly charged by charging it by electron beams.

In the above-mentioned structure of the electrophotographic plate, As in the third Se layer can be substituted by Ge. The maximum concentration of Ge in the Se layer is set at 10 to 30% by weight.

Furthermore, As and Ge may be present in combination in the third Se layer. In this case, a tentative value of the maximum concentration is determined by interpolation of the ratio of As and Ge based on the maximum concentration in case of As alone and the maximum concentration in case of Ge alone.

The operation of a laser beam printer equipment as a typical instance of application of the electrophotographic plate according to the present invention will now be described. The structure of the laser beam printer equipment is outlined in FIG. 5.

Figure 5:
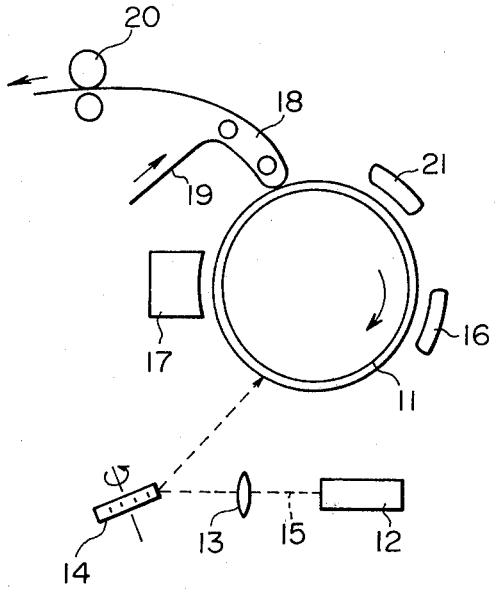
FIG. 5 is a diagram illustrating the structure of a laser beam printer equipment.

Referring to FIG. 5, the electrophotographic plate according to the present invention is formed on the surface of a rotary drum 11. When the rotary drum 11 is formed of a conductor such as aluminum, the rotary drum 11 per se may be used as the conductor substrate of the electrophotographic plate according to the present invention. When a rotary drum formed of glass or the like is used, a conductor such as a metal is coated on the surface of the rotary drum of glass, and a plurality of predetermined Se layers are laminated thereon. Beams 15 from a light source 12 such as a semiconductor laser pass through a beam collecting lens 13 and impinge on a polyhedral mirror 14, and they are reflected from the mirror 14 and reach the surface of the drum 11.

Charges induced on the drum 11 by a charger 16 are neutralized by signals imparted to the laser beams to form a latent image. The latent image region arrives at a toner station 17 where a toner adheres only to the latent image area irradiated with the laser beams. This toner is transferred onto a recording paper 19 in a transfer station 18. The transferred image is thermally fixed by a fixing heater 20. Reference numeral 21 represents a cleaner for the drum 11.

There may be adopted an embodiment in which a glass cylinder is used as the drum, a transparent conductive layer is formed on the glass cylinder and predetermined Se layers are laminated thereon.

In this embodiment, the writing light source may be disposed in the cylindrical drum. In this case, beams are incident from the conductor side of the electrophotographic plate.

Needless to say, applications of the electrophotographic plate are not limited to the above-mentioned embodiments.

In the instant specification and appended claims, by the term "electrophotographic plate" is meant one that is used for an electrophotographic device, a laser beam printer equipment and the like in the fields of electrophotography, printing, recording and the like.

The present invention will now be described in detail with reference to the following Examples that by no means limit the scope of the invention.

EXAMPLE 1

Figure 6:
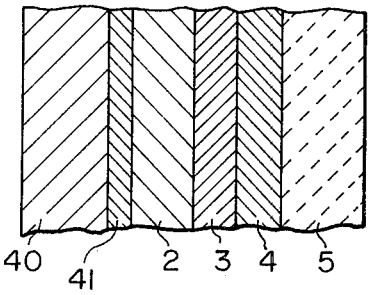

An electrophotographic plate having a structure shown in FIG. 6, which is different from the structure shown in FIG. 1 only in the conductor, is illustrated in this Example.

Figure 7:
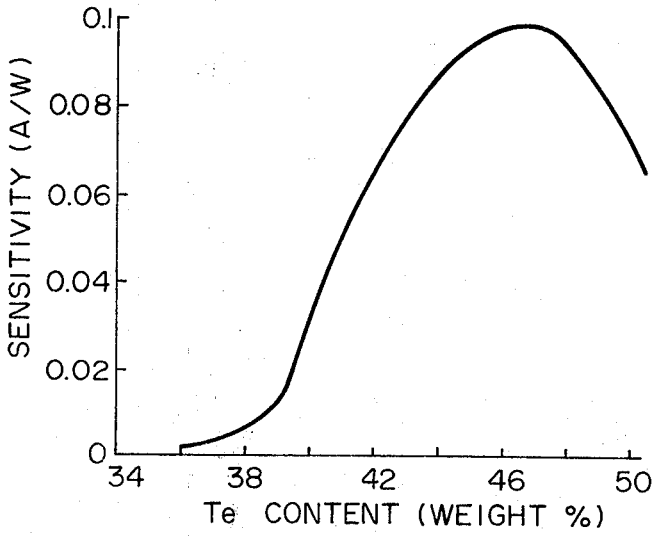
FIG. 7 is a diagram illustrating the relation between the Te concentration and the sensitivity.
Figure 8:
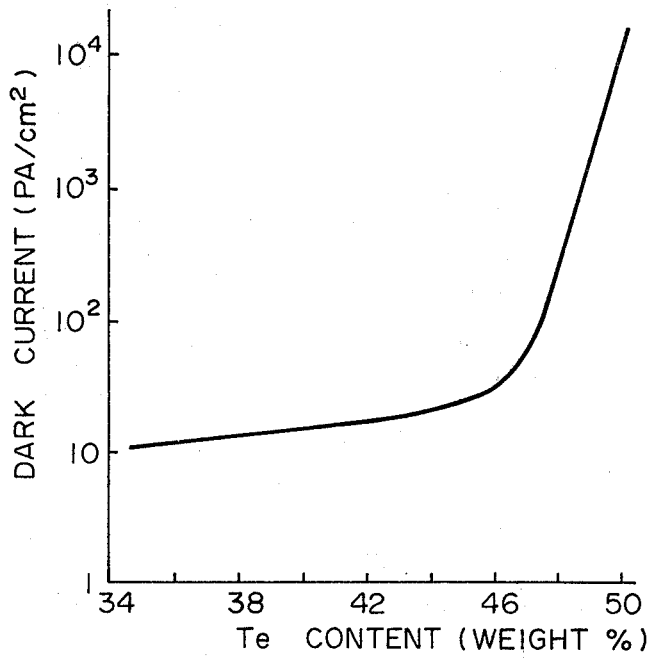
FIG. 8 is a diagram illustrating the relation between the Te concentration and the dark current.

A tin oxide transparent conductive layer 41 having a thickness of 200 nm is formed on a glass substrate 40 according to the CVD method (chemical vapor deposition method) and this glass substrate is used as the conductor. Two evaporation source of Se and $As_2Se_3$ are simultaneously heated and evaporated in vacuum of $5\times10^{-6}$ Torr by resistance heating, whereby a first Se layer 2 containing 6% by weight of As and a thickness of 30 nm is formed. Subsequently, by simultaneously evaporating three evaporation sources of Se, $As_2Se_3$ and Te in vacuum of $5\times10^{-6}$ Torr, a second Se layer 3 containing 36 to 50% by weight of Te and 4% by weight of As and having a thickness of 60 nm is formed. Furthermore, by simultaneously evaporating two evaporation sources of Se and $As_2Se_3$ in vacuum of $5\times10^{-5}$ Torr while the amount of evaporated $As_2Se_3$ is gradually decreased, a third Se layer 4 having a thickness of 60 nm in which the As concentration is gradually reduced from 40% by weight to 3% by weight is formed. Then, the glass substrate is heated at 60° to 80° C., two evaporation sources of Se and As are simultaneously evaporated in vacuum of $1\times10^{-5}$ Torr to form a fourth Se layer 5 containing 3% by weight of As and a thickness of 3.85 μm. The fourth Se layer 5 may be formed solely of Se. A voltage of 50 V is applied to the so formed electrophotographic plate while a positive polarity is maintained in the tin oxide transparent conductor, and the sensitivity to beams of 750 nm incident from the glass substrate and the dark current are determined to obtain results shown in FIGS. 7 and 8. As is seen from FIG. 7, as the Te concentration is increased from 36% by weight to 40% by weight, the sensitivity is gradually increased. As the Te concentration is increased from 40% by weight to 47% by weight, the sensitivity is abruptly increased, but if the Te content exceeds 47% by weight, the sensitivity is reduced on the contrary. For reference, in an electrophotographic plate having a Te content of 30% by weight, which is prepared in the same manner as described above, the sensitivity to beams of 750 nm is $10^{-3}$ A/W and in an electrophotographic plate comprising Se alone, the sensitivity to beams of 750 nm is $10^{-4}$ A/W. Accordingly, it will readily be understood that the sensitivity of the electrophotographic plate in which the Te content is adjusted to 40 to 47% by weight is very high.

Figure 9:
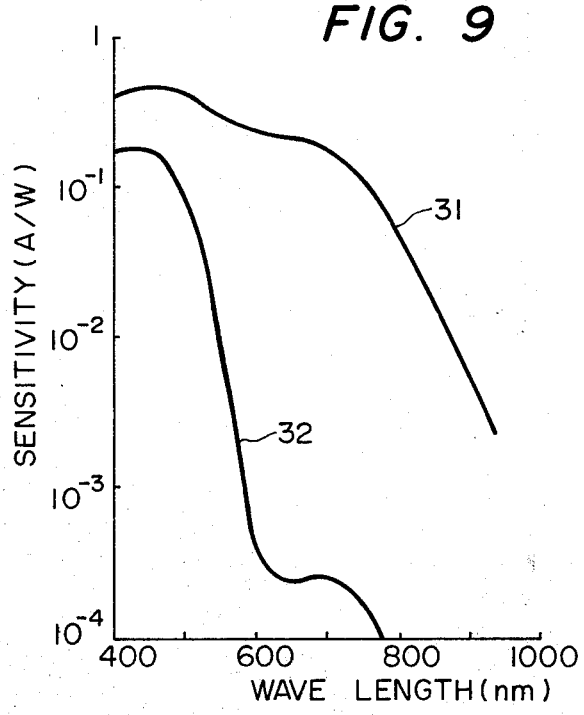
FIG. 9 is a diagram comparing the spectral sensitivity of the electrophotographic plate according to the present invention with that of an electrophotographic plate comprising Se alone.

For reference, the spectral sensitivity characteristics of the electrophotographic plate in which the Te content is adjusted to 47% by weight and the electrophotographic plate comprising Se alone are shown in FIG. 9. In FIG. 9, curve 31 indicates the spectral sensitivity characteristic of the electrophotographic plate of the present invention and curve 32 indicates the spectral sensitivity characteristic of the electrophotographic plate comprising Se alone. From these curves, it is seen that the electrophotographic plate of the present invention has a higher sensitivity to beams in the wavelength region of from 400 to 900 nm and it is especially sensitized to beams having a wavelength of at least 600 nm. From dark current characteristics shown in FIG. 8, it is seen that the dark current is gradually increased when the Te concentration is up to 47% by weight but the dark current is abruptly increased if the Te content exceeds 47% by weight. In conclusion, it will be understood that the Te concentration should be at least 40% by weight in order to attain a sufficient sensitivity to beams in the wavelength region of 700 to 800 nm and the Te concentration should be up to 47% by weight in order to reduce the dark current. In the above-mentioned electrophotographic plate according to the present invention, the residual potential is lower than 3%. In the case where the final Se layer having an As content of 3% by weight and a thickness of 3.85 μm is formed at room temperature, the residual potential is higher than 10%. Also when the entire layers of the electrophotographic plate are formed at 70° C., the residual potential is lower than 3%. For reference, it is added that whether the substrate is heated or not, no substantial difference is brought about in the sensitivity or the dark current. In the above illustration, for formation of the electrophotographic plate, there is adopted a method in which evaporation sources Se and $As_2Se_3$ or three evaporation sources of Se, $As_2Se_3$ and Te are used and they are simultaneously heated and vacuum-deposited on the substrate, whereby a desired layer structure is formed in the electrophotographic plate. Even if this simultaneous evaporation method is not adopted, the intended electrophotographic plate can be formed by passing two evaporation sources Se and $As_2Se_3$ or three evaporation sources of Se, $As_2Se_3$ and Te in succession on the substrate. In the former case, a film of Se and a film of $As_2Se_3$ are alternately laminated and in the latter case, films of Se, $As_2Se_3$ and Te are alternately laminated. If the thickness of each film is smaller than 3 nm, an electrophotographic plate having the same characteristics as those of the electrophotographic plate prepared by the simultaneous evaporation method can be obtained.

EXAMPLE 2

Preparation of an electrophotographic plate having a structure shown in FIG. 1 is illustrated in this Example.

Figure 11:
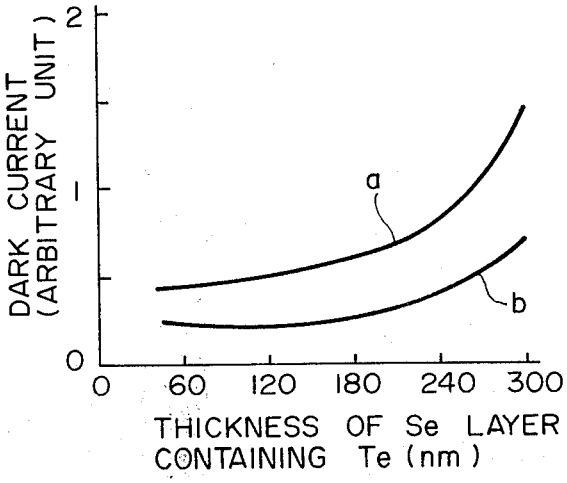
FIG. 11 is a diagram illustrating the relation between the thickness of the Te-containing Se layer and the dark current.

An aluminum plate is used as the conductor 1, and $Al_2O_3$ is evaporated and deposited in a thickness of 30 nm by sputtering or $CeO_2$ is evaporated and deposited in a thickness of 30 nm by resistance heating. These two deposited aluminum plates and the untreated aluminum plate are used as the substrate independently. According to the method described in Example 1, an Se layer 2 containing 6% by weight of As and having a thickness of 100 nm is formed on each substrate and an Se layer 3 containing 4% by weight of As and 45% by weight of Te and having a thickness varying in the range of 40 to 300 nm is formed thereon. On this Se layer 3, an Se layer 4 having a thickness of 60 nm, in which the As content is gradually reduced from 40% by weight to 3% by weight, is formed. Then, the aluminum substrate is heated at 50° to 70° C. to form an electrophotographic plate including an Se layer 5 having an As content of 0% by weight and a thickness of 4 μm. The surface of the electrophotographic plate is charged at −150 V by corona discharge, and laser beams of 750 nm are applied from the side opposite to the aluminum plate side and the sensitivity is determined to obtain results shown in FIG. 10. In FIG. 10, the optical energy necessary for reducing the surface potential to $\frac{1}{2}$ is plotted as the sensitivity. Accordingly, the smaller is the energy, the higher is the sensitivity. From FIG. 10, it is seen that when the thickness of the Se layer containing 45% by weight of Te is 200 nm, the sensitivity is highest. When the thickness is smaller than 60 nm, the sensitivity is abruptly reduced. This sensitivity is irrelevant to the presence or absence of the $Al_2O_3$ or $CeO_2$ film. The dark current characteristics of the above electrophotographic plates formed on the aluminum substrate are shown by curve a in FIG. 11. As indicated by curve b in FIG. 11, the dark current of the electrophotographic plate having an $Al_2O_3$ or $CeO_2$ film formed thereon is about $\frac{1}{2}$ of the dark current shown by curve a. From FIG. 11, it is seen that if the thickness of the Se layer containing 45% by weight of Te is larger than 240 nm, the dark current is abruptly increased. From the foregoing results, it will readily be understood that it is preferred that the thickness of the Te-containing Se layer be 60 to 240 nm, and that the presence of the insulating layer of $Al_2O_3$ or $CeO_2$ is effective for reducing the dark current.

EXAMPLE 3

Preparation of an electrophotographic plate having a structure shown in FIG. 6 is illustrated in this Example.

Figure 12:
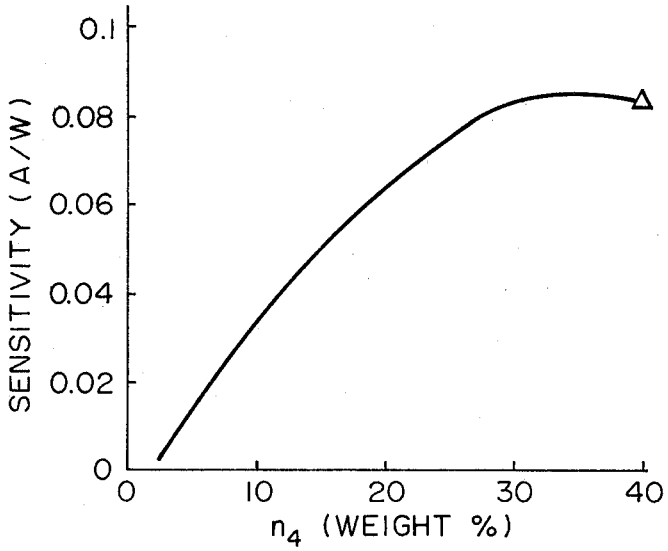
FIG. 12 is a diagram illustrating the relation between the peak of the As concentration and the sensitivity.
Figure 13:
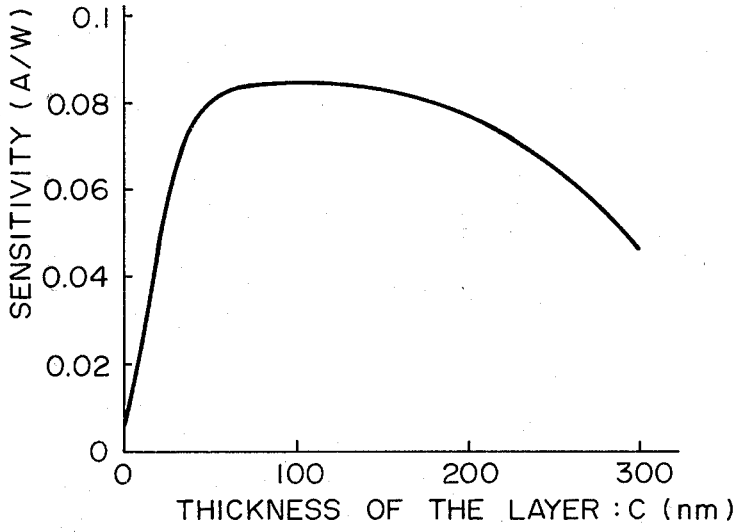
FIG. 13 is a diagram illustrating the relation between the thickness c of the electrophotographic plate shown in FIG. 1 and the sensitivity.

The preparation method is the same as the method described in Example 1. A glass sheet 40 is used as the substrate, and a tin oxide transparent conductive layer 41 having a thickness of 200 nm is formed on this substrate according to the CVD method. Further, an Se layer 2 containing 6% by weight of As and a thickness of 30 nm is formed on the glass substrate, and a layer 3 containing 41% by weight of Te and 3% by weight of As and a thickness of 60 nm is formed on the layer 2. As shown in FIG. 1, an Se layer 4 having a peak As concentration n4 and a thickness c is formed on the layer 3. In one group, the thickness c is fixed to 60 nm and the concentration n4 is changed from 3% by weight to 40% by weight. In another group, the concentration n4 is fixed to 40% by weight and the thickness c is changed from 0 to 300 nm. In still another group, As is uniformly incorporated at a content n4 of 40% by weight and the thickness c of this Se layer is adjusted to 60 nm (the As concentration is not gradually decreased in the thickness direction as in FIG. 1). An Se layer 5 having a thickness of 4 μm and containing 3% by weight As is formed on the layer 4 in each sample. To each of the so prepared electrophotographic plates, a voltage of 50 V is applied while a positive polarity is maintained in the tin oxide transparent electrode, and the sensitivity to beams having a wavelength of 700 nm is determined to obtain results shown in FIGS. 12 and 13. FIG. 12 shows the results obtained when the thickness c is fixed to 60 nm and the concentration n4 is changed from 3 to 40% by weight, and FIG. 12 shows the results obtained when the concentration n4 is fixed to 40% by weight and the thickness c is changed in the range of from 0 to 300 nm. From FIG. 12, it is seen that the sensitivity is highest when the As peak concentration is 30 to 40% by weight. The mark Δ in FIG. 12 indicates the sensitivity of the electrophotographic plate in which As is uniformly incorporated at a content of 40% by weight. It is seen that even if the As concentration is not gradually decreased but As is uniformly incorporated, a high sensitivity can be similarly obtained. From FIG. 13, it is seen that the sensitivity is substantially equal if the thickness c is in the range of from 60 to 200 nm. Ordinarily, the thickness c is selected in the range of from 40 to 240 nm.

EXAMPLE 4

Figure 14:
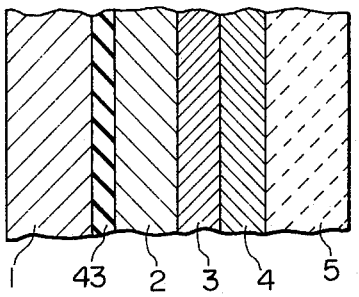
FIG. 14 is a sectional view showing still another instance of the structure of the electrophotographic plate according to the present invention.

The electrophotographic plate according to the present invention is illustrated with reference to FIG. 14.

An aluminum plate is used as the conductor 1, and $CeO_2$ is vapor-deposited in a thickness of 30 nm as the n-type oxide layer on the conductor 1. An Se layer containing 6% by weight of As and having a thickness of 60 nm is formed on the layer 43, and an Se layer 3 containing 45% by weight of Te and 3% by weight of As and having a thickness of 180 nm is formed on the layer 2. An Se layer 4 having a thickness of 60 nm, in which the As concentration is gradually decreased from 40% by weight to 3% by weight, is formed on the Se layer 3. Then, an Se layer 5 having an As concentration n5 and a thickness of 50 μm is formed while heating the aluminum substrate 1 at 50° to 80° C. to form an electrophotographic plate. The As concentration n5 is adjusted to 0, 3, 5 or 10% by weight. Each of the so prepared 4 electrophotoconductive plates is charged by corona discharge so that the aluminum plate 1 comes to have a positive polarity, and a voltage of 600 V is applied and laser beams having an emission wavelength of 774 nm are applied from the side opposite to the side of the aluminum substrate 1. The sensitivity is examined to find that the sensitivity is 6 $mJ/m^2$ irrespectively of the As concentration n5. However, the residual potential is remarkably influenced by the As concentration n5. When the As concentration n5 is 0 or 3% by weight, the residual potential is less than 3% of the initial potential, but when the As concentration n5 is 5% by weight or 10% by weight, the residual potential is about 7% or more than 10% of the initial potential. From these reuslts, it is seen that it is preferred that the As concentration n5 be lower than 10% by weight.

EXAMPLE 5

Preparation of an electrophotographic plate having a structure shown in FIG. 3 is illustrated in this Example.

An aluminum plate is used as the conductor 6, and an Se layer 11 containing 10% by weight of As and a thickness of 30 nm is formed on the conductor 6. Then, an Se layer 7 having a thickness of 50 μm is formed on the layer 11 while heating the aluminum plate at 50° to 80° C., and an Se layer 8 having a thickness of 60 nm, in which the As concentration is gradually increased from 0% by weight to 40% by weight, is formed on the Se layer 7. Then, an Se layer 9 containing 45% by weight of Te and 4% by weight of Se and a thickness of 180 nm is formed on the layer 8, and an Se layer 10 containing 6% by weight of As and a thickness of 100 nm is formed on the layer 9. $CeO_2$ is vapor-deposited or not vapor-deposited in the thickness of 30 nm on the Se layer 10. Each of the so formed electrophotographic plates is charged by corona discharge so that the aluminum substrate 6 comes to have a negative polarity, and a voltage of 600 V is applied. Laser beams having an emission wavelength of 774 nm are applied from the side opposite to the side of the aluminum substrate, and the sensitivity is determined. It is found that as in case of the electrophotographic plate illustrated in Example 4, the sensitivity is 6 $mJ/m^2$ irrespectively of the presence or absence of the $CeO_2$ film. However, in case of the electrophotographic plate having the $CeO_2$ film, the dark current (dark decay) is about ½ of the dark current in case of the electrophotographic plate free of the $CeO_2$ film. Thus, it is seen that the dark current characteristic is improved by the $CeO_2$ film.

As will readily be understood from the foregoing illustration, in an electrophotographic plate having the structure specified in the present invention, the sensitivity to beams in the wavelength region of from 600 to 800 nm is much higher than the sensitivity of the conventional electrophotographic plate to the above beams. The sensitivity of the electrophotographic plate according to the present invention to beams having a wavelength of 774 nm is comparable to the sensitivity of the conventional Se electrophotographic plate to beams having a wavelength of 442 nm.

Accordingly, it will readily be understood that the electrophotographic plate according to the present invention is suitable as an electrophotographic plate for an He-Ne or semiconductor laser beam printer equipment.

EXAMPLE 6

A glass substrate on which an tin oxide transparent conductive film having a thickness of 200 nm is formed according to the customary CVD method is used as the conductor. A first Se layer containing 6% by weight of As and having a thickness of 30 nm is formed on the glass substrate by simultaneously evaporating two evaporation sources of Se and $As_2O_3$ in vacuum of $5\times10^{-6}$ Torr by resistance heating, and a second Se layer containing 40 to 47% by weight of Te and 4% by weight of As and having a thickness of 60 nm is formed on the first Se layer by simultaneously evaporating three evaporation sources of Se, $As_2Se_3$ and Te in vacuum of $5\times10^{31}$ 6 Torr. Further, a third Se layer having a thickness of 60 nm, in which the Ge concentration is gradually decreased from 40% by weight to 3% by weight, is formed on the second Se layer by simultaneously evaporating two evaporation sources of Se and Ge while gradually reducing the amount evaporated of Ge. Then, two evaporation sources of Se and Ge are simultaneously evaporated in vacuum of $1\times10^{-5}$ Torr while heating the glass substrate at 60° to 80° C. to form a fourth Se layer containing 3% by weight of As and having a thickness of 3.85 μm. Thus, an electrophotographic plate having desirable characteristics can be obtained.

An electrophotographic plate having similar characteristics is obtained when As and Ge are incorporated in combination into the third Se layer instead of Ge.

EXAMPLE 7

Preparation of an electrophotographic plate having a structure shown in FIG. 6, in which an organic semiconductor layer is used, is illustrated in this Example.

A glass plate 40 on which Al 41 is deposited in a thickness of about 200 nm is used as the conductor, and a first Se layer 2 containing 6% by weight of As and a thickness of 30 nm is formed on the conductor by simultaneously evaporating two evaporation sources of Se and $As_2Se_3$ in vacuum of $5\times10^{-6}$ Torr by resistance heating. Then, a second Se layer 3 containing 45% by weight of Te and 4% by weight of As and having a thickness 180 nm is formed on the first Se layer 2 by simultaneously evaporating three evaporation sources of Se, $As_2Se_3$ and Te in vacuum of $5\times10^{-6}$ Torr. A third Se layer 4 having a thickness of 60 nm, in which the As concentration is gradually decreased from 40% by weight to 3% by weight, is formed on the second Se layer 3 by simultaneously evaporating two evaporation sources of Se and $As_2Se_3$ in vacuum of $5\times10^{-5}$ Torr while gradually reducing the amount evaporated of $As_2Se_3$. A solution of poly(vinyl carbazole) in cyclohexanone is spin-coated on the third Se layer 4 to form a poly(vinyl carbazole) layer having a thickness of 10 μm.

The so formed electrophotographic plate is negatively charged by a corona charger, and laser means having a wavelength of 750 nm are applied from a semiconductor laser device and the energy necessary for reducing the potential to ½ is determined. It is found that the necessary energy is 4 mJ/m². At this test, it is found that electrophotographic characteristics such as dark decay characteristic are good.

Figure 15A:
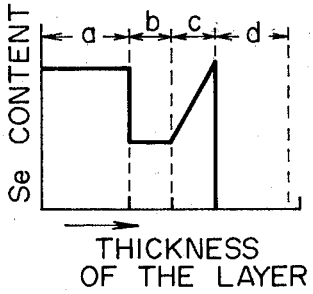
FIGS. 15*a* to 15*c* are diagrams illustrating the Se, As and Te concentration distributions in the electrophotographic plate including an organic semiconductor layer according to the present invention.
Figure 15B:
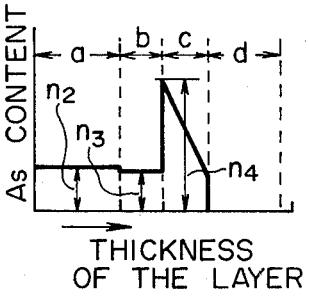
Figure 15C:
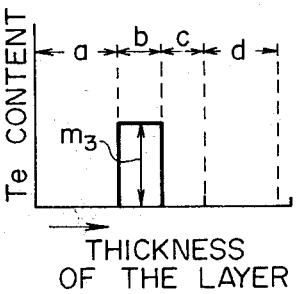

Even if the organic semiconductor is used, the laminated structure is the same as shown in FIGS. 2*a* to 2*c* except the portion of the organic semiconductor layer. The ingredient concentration distributions in this electrophotographic plate including the organic semiconductor layer are shown in FIGS. 15*a* to 15*c* where the Se, As and Te concentration distributions are illustrated.

Figure 16:
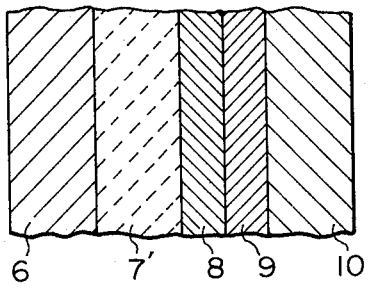
FIG. 16 is a sectional view illustrating the structure of the electrophotographic plate including an organic semiconductor layer according to the present invention.
Figure 17A:
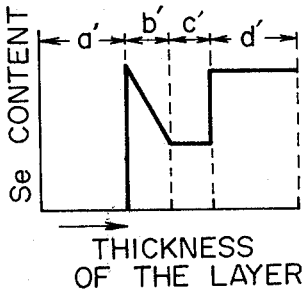
FIGS. 17*a* to 17*c* are diagrams illustrating the Se, As and Te concentration distributions in the electrophotographic plate shown in FIG. 16.
Figure 17B:
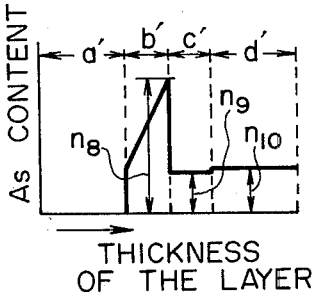
Figure 17C:
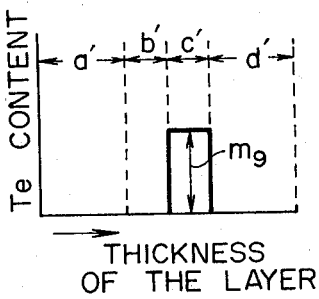

As in the case where the electrophotographic plate is formed of Se-type materials alone, the respective layers may be laminated on the substrate in an order reverse to the above-mentioned order. FIG. 16 is a sectional view illustrating this lamination state, and FIGS. 17*a* to 17*c* show the Se, As and Te concentration distributions in this modification. In FIG. 16, the same reference numerals as used in FIG. 3 represent the same members as in FIG. 3. Reference numeral 7' represents the organic semiconductor layer. When an organic semiconductor is used as illustrated above, the Se layer 11 shown in FIG. 3 need not be formed. In the embodiment shown in FIG. 3, this Se layer 11 is formed so as to prevent crystallization of Se in the interface between the conductor layer 6 and the Se layer. Therefore, when an organic semiconductor layer is formed on the conductor layer, a layer for preventing crystallization of Se need not be formed.

What is claimed is:

1. An electrophotographic plate having a substrate and a laminated structure of Se layers on said substrate, at least the surface of the substrate nearer said laminated structure being electrically conductive, the laminated structure comprising, in the following sequence, (a) a first Se layer containing 3 to 10% by weight As and having a thickness in a range 20 nm–1 μm, (b) a second Se layer containing 40 to 47% by weight Te and 3 to 10% by weight As and having a thickness in a range 60 nm–300 nm, (c) a third Se layer which contains at least one member selected from the group consisting of As at maximum concentration of 30 to 40% by weight and Ge at maximum concentration of 10 to 30% by weight and having a thickness in a range 60 nm–200 nm, said third Se layer having a bandgap intermediate between the respective bandgaps of said second layer and a fourth layer, and (d) a fourth layer which is an Se layer containing up to 10% by weight of As, wherein either the first layer or said fourth layer is nearest to the said electrically conductive surface of the substrate, whereby said plate has a sensitivity to beams having a wavelength of 550–800 nm.

2. An electrophotographic plate as set forth in claim 1, wherein said fourth layer is formed by vacuum evaporation disposition while the substrate for the deposition is maintained at 50° to 80° C.

3. An electrophotographic plate as set forth in claim 1, wherein said fourth layer contains up to 3% by weight As.

4. An electrophotographic plate as set forth in claim 1, wherein said fourth Se layer is nearest to said electrically conductive surface of said substrate, and wherein a fifth Se layer containing 3%–10% by weight As is positioned between the substrate and fourth Se layer.

5. An electrophotographic plate as set forth in claim 4, wherein the thickness of said fifth Se layer is 20–100 nm.

6. A process for the preparation of electrophotographic plates defined in claim 1 which comprises forming on a substrate which is electrically conductive at least on the surface thereof said first Se layer, said second Se layer, said third Se layer and said fourth Se layer independently by vacuum evaporation deposition, wherein at least when said fourth Se layer is formed, a prepared substrate for vacuum evaporation deposition is maintained at 50° to 80° C.

7. A process for the preparation electrophotograpic plates according to claim 6 wherein said first, second, third and fourth Se layers are formed independently by vacuum evaporation deposition while the substrate which is electrically conductive at least on the surface thereof is maintained at 50° to 80° C.

8. An electrophotographic plate having a substrate and a laminated structure provided on said substrate, at least the surface of the substrate nearer said laminated structure being electrically conductive, the laminated structure comprising, in the following sequence, (a) a first Se layer containing 3 to 10% by weight As and having a thickness in a range 20 nm–1 μm, (b) a second Se layer containing 40 to 47% by weight Te and 3 to 10% by weight As and having a thickness in a range 60 nm–300 nm, (c) a third layer of an organic semiconductor material which is photoconductive or of Se which contains at least one member selected from the group consisting of As at maximum concentration of 30 to 40% by weight and Ge at maximum concentration of 10 to 30% by weight and which has a thickness in a range 60 nm–200 nm, said third layer having a bandgap intermediate between the respective bandgaps of said second layer and a fourth layer, and (d) a fourth layer which is an organic semiconductor layer which is photoconductive and satisfies the withstand voltage of said laminated structure, wherein either said first layer or said fourth layer is nearest to the said electrically conductive surface of the substrate, whereby said plate has a sensitivity to beams having a wavelength of 550–800 nm.

9. An electrophotographic plate as set forth in claim 8, wherein an organic semiconductor material is used for said third layer.

10. An electrophotographic plate as set forth in claim 8, wherein said third layer is the Se-containing layer.

11. An electrophotographic plate as set forth in claim 8, wherein the organic semiconductor layer has an electric resistance range of $10^8$–$10^{15}\Omega$-cm.

12. An electrophotographic plate as set forth in claim 8, wherein said organic semiconductor layer is made of a material selected from the group consisting of poly (vinyl carbazole) and derivatives thereof and pyrazoline and derivatives thereof.

13. An electrophotographic plate as set forth in claim 8 or 12, wherein said organic semiconductor layer has a thickness of 1 μm to 20 μm.

14. An electrophotographic plate as set forth in claim 1 or 8, wherein the thickness of the second Se layer is 60 to 200 nm.

15. An electrophotographic plate as set forth in claim 1 or 8, wherein the third layer has a bandgap intermediate the bandgaps of the second and fourth layers such that an energy barrier to transfer of holes between the second and fourth layers is substantially eliminated.

16. An electrophotographic plate as set forth in of claims 1 or 8 wherein a blocking layer is formed on the substrate and said first Se layer or said fourth layer is contiguous to the surface of said blocking layer.

17. An electrophotographic plate as set forth in claim 16, wherein said blocking layer has a thickness of 5 to 50 nm.

18. An electrophotographic plate as set forth in claim 1 or 8 wherein a protecting layer is formed contiguously to the surface of said first Se layer or said fourth layer, which surface is not nearest to the substrate.

19. An electrophotographic plate as set forth in claim 1 or 10, wherein the third Se layer consists essentially of Se and said at least one member.

20. An electrophotographic plate as set forth in claim 1 or 10 wherein the concentration of As and/or Ge in said third Se layer is gradually decreased from the face contiguous to said second Se layer to the face contiguous to said fourth layer.

* * * * *